US006318215B1

(12) United States Patent
Armfield, IV

(10) Patent No.: US 6,318,215 B1
(45) Date of Patent: Nov. 20, 2001

(54) OPENED-END RATCHET WRENCH

(76) Inventor: Samuel L. Armfield, IV, 107 Silver Lake Rd., Hollis, NH (US) 03049

( * ) Notice: Subject to any disclaimer, the term of this patent is extended or adjusted under 35 U.S.C. 154(b) by 0 days.

(21) Appl. No.: 09/660,157

(22) Filed: Sep. 12, 2000

(51) Int. Cl.[7] ..... B25B 13/46
(52) U.S. Cl. ..... 81/58.2; 87/60
(58) Field of Search ..... 81/58.2, 57.29, 81/57.3, 60

(56) References Cited

U.S. PATENT DOCUMENTS

| | | | |
|---|---|---|---|
| 4,604,919 | 8/1986 | Rollo | 81/58 |
| 5,249,487 | 10/1993 | Armfield, IV | 81/58 |
| 5,924,341 | 7/1999 | Brooks | 81/58.2 |

*Primary Examiner*—James G. Smith
(74) *Attorney, Agent, or Firm*—Carothers & Carothers

(57) ABSTRACT

An open-end hand held ratchet wrench which has a rigid semi-circular jaw cradle defining an interior semi-circular channel which is substantially U-shaped in cross section. A handle extends off the opposite end of the cradle. Four radial recesses are arranged in spaced relationship in the bottom of the cradle channel and a gear is mounted in each one of these recesses for rotation on their respective gear axis. One or more ratchet pawls are also mounted in the cradle and positioned to prevent rotation of at least one of the gears in one direction. A cogwheel having a toothed outer perimeter is provided and dimensioned for meshing with the gears in the cradle channel and the cogwheel has a polygonal throughbore and a slot extending between the outer perimeter and the throughbore. The polygonal throughbore may be provided in different sizes to engage bolt heads or nuts of different sizes.

4 Claims, 2 Drawing Sheets

OPENED-END RATCHET WRENCH

FIELD OF THE INVENTION

The invention relates in general to hand tools and more particularly to open-end ratchet wrenches for manipulating nuts or bolt heads.

BACKGROUND OF THE INVENTION

Open-end ratchet wrenches and pliers have been designed in many different forms or configurations. They are necessary to provide the tightening or loosening of a threaded bolt or nut in tight or limited spaces. As examples, see U.S. Pat. Nos. 4,604,919; 5,249,487 and 5,924,341.

Problems encountered with open-end ratchet wrenches of the prior art are inadequate and un-uniform drive support of the socket portion of the wrench which directly engages the nut or bolt head to be manipulated, and/or inadequate or sloppy gripping action between the socket portion and the nut or bolt head to be manipulated. It is a principal object of the present invention to eliminate these disadvantages.

For example, in the structure illustrated in U.S. Pat. No. 5,924,341, cogwheel 20 is supported in cradle 28 by opposed pawls 17 and 40 which are spring biased to prevent rotation of cogwheel 20 in one direction. This arrangement provides un-uniform drive support for cogwheel 20 in cradle 28 as it is obvious when viewing the figures that when cogwheel 20 rotates counterclockwise relative to the cradle 28 there is nothing in the bottom of the cradle 28 to support the teeth 22 of cogwheel 20, which are free to engage the bottom U-shaped wall of cradle 28. The same problem arises with the structure shown in U.S. Pat. No. 4,604,919 wherein opposed spring biased pawls 24 prevent rotation in one direction of socket 40, but the bottom annular surface of socket 40 is permitted to slidably engage with friction against the surface 19 of the wrench head 16, providing undesirable friction drive engagement of the socket portion of the wrench.

Similarly, the present inventor's wrench as illustrated in U.S. Pat. No. 5,249,487 utilizes toothed faces 14 of gears to engage the outer faces and corners 20 of the nut 19 which provides a sloppy gripping action between the socket portion and the nut or bolt head to be manipulated.

SUMMARY OF THE INVENTION

The open-end handheld ratchet wrench of the present invention is comprised of a rigid semi-circular jaw cradle defining an interior semi-circular channel which is substantially U-shaped in cross section and oriented so that an open side of the channel faces the axis of the cradle whereby the channel has two spaced apart open-ends. An elongated handle is secured to this cradle and extends radially outward therefrom on a side opposite from the channel. At least two radial recesses are arranged in spaced relationship in a bottom portion of this cradle channel and they face the cradle axis. A gear is mounted in each of these recesses for rotation on a gear axis which is parallel to the cradle axis with a portion of each gear protruding into the channel. At least one ratchet pawl is mounted in the cradle and positioned to prevent rotation of at least one of these gears in one direction. A cogwheel having a toothed outer perimeter is provided and dimensioned for meshing with the gears. The cogwheel is further provided with a polygonal throughbore and a slot extending between the outer perimeter and the throughbore.

The polygonal throughbore is dimensioned to mate a particular nut or bolt head for manipulation and the slot is provided for access of a threaded shaft.

The cogwheel is dimensioned to be freely slidable into the open ends of the channel for resting against and meshing the toothed outer perimeter thereof with the gears.

A rachet pawl may be mounted in the cradle for each one of the gears and positioned to prevent rotation of all of the gears in the one direction. In this regard also, at least two gears are required and four or more such radial recesses with corresponding gears may be provided in spaced relationship in the bottom of the cradle channel.

Generally at least two and normally a number of the cogwheels will be provided which have substantially identical outer diameters for use with the tool, but have respective polygonal throughbores of different sizes for mating and manipulating corresponding nuts and bolt heads of different sizes.

BRIEF DESCRIPTION OF THE DRAWINGS

Other objects and advantages appear hereinafter in the following description and claims. The accompanying drawings show, for the purpose exemplification, without limiting the invention or the appended claims, certain practical embodiments illustrating the principals of this invention, wherein:

DETAILED DESCRIPTION OF A PREFERRED EMBODIMENT

Figure 2:
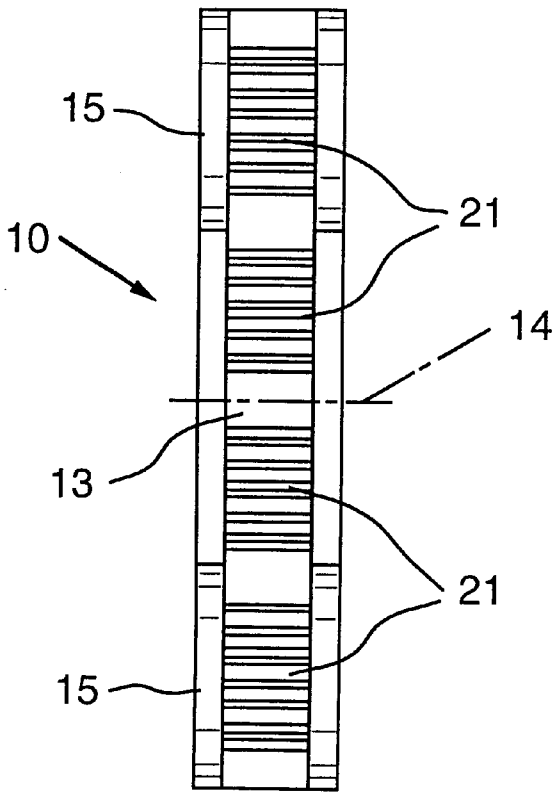
FIG. 2 is a view in front elevation of the wrench shown in FIG. 1 with the cogwheel removed to expose the interior of the cradle channel of the wrench.
Figure 1:
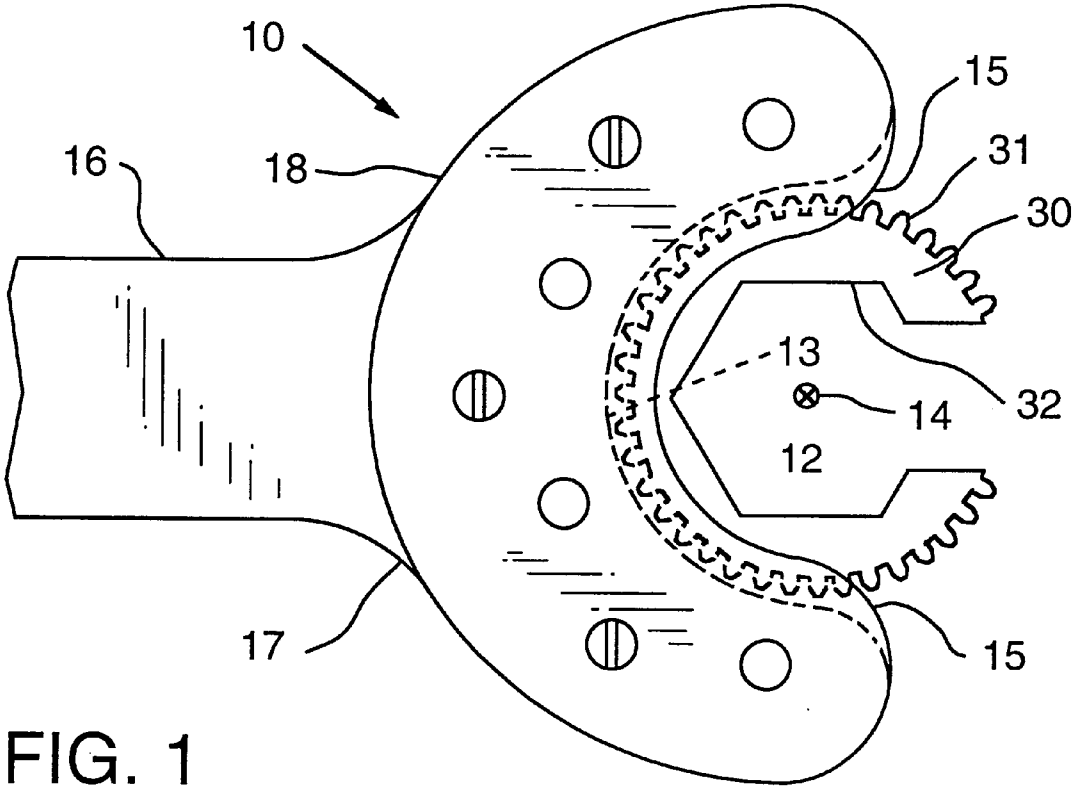
FIG. 1 is a view in side elevation of the preferred embodiment of the open-end hand held ratchet wrench of the present invention.
Figure 3:
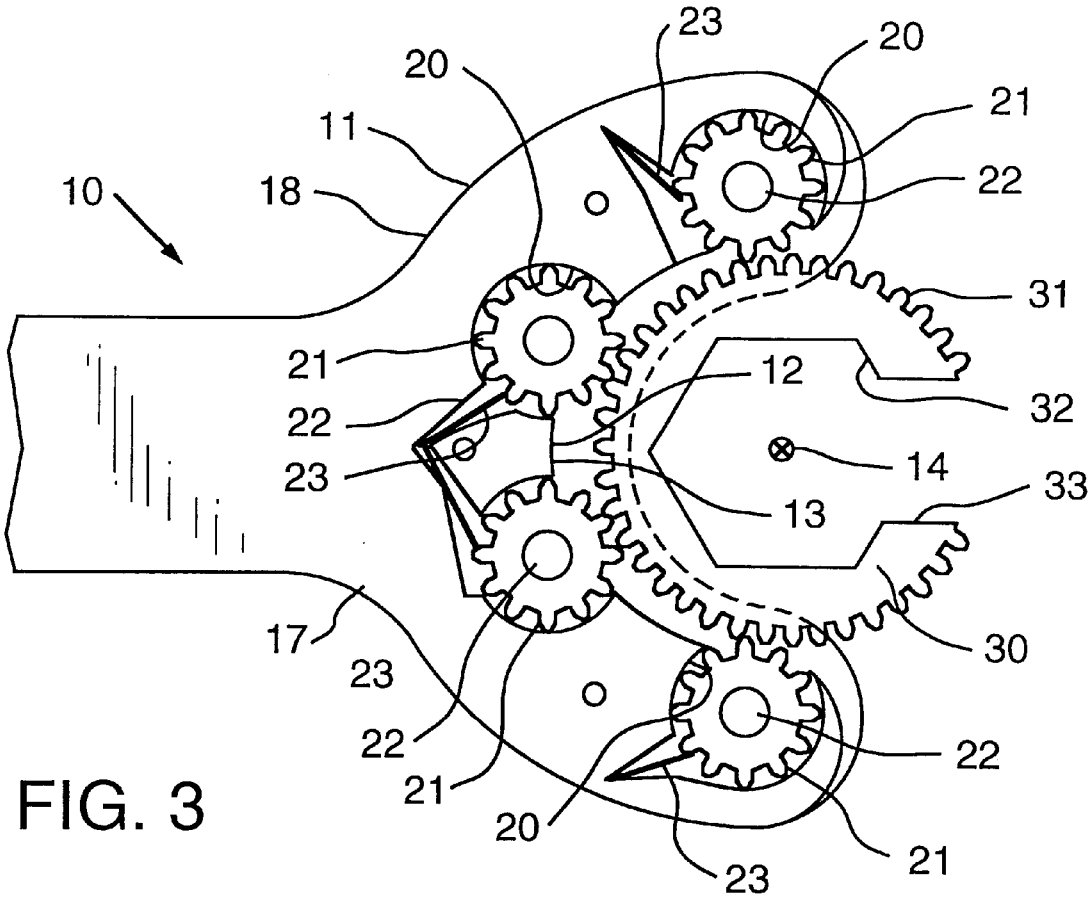
FIG. 3 is a view in side elevation of the wrench shown in FIG. 1 with the U-shaped cover plate removed to expose the interior workings.

Referring to FIGS. 1 through 3, the open-end hand held rachet wrench 10 of the present invention includes a rigid semi-circular jaw cradle 11 defining an interior semi-circular channel 13 which is substantially U-shaped in cross section and oriented so that an open side 12 of channel 13 faces axis 14 of cradle 11 whereby channel 13 has two spaced apart open ends 15. An elongated handle 16 has one end 17 secured to cradle 11 and extending radially outward from cradle 11 on a side 18 opposite from channel 13.

At least two, and here four, radial recesses 20 are provided in the bottom portion of cradle channel 13 and are arranged in spaced relationship. All of the recesses 20 face the axis 14 of the cradle.

A gear 21 is mounted in each recess 20 for rotation on their respective gear axis 22 which are parallel to each other and to cradle axis 14 with a portion of each gear protruding into channel 13.

At least one, and here four, ratchet pawls 23 are mounted in cradle 11 and they are positioned within their respective retaining cavities to prevent rotation of the gears 21 in one direction. As is seen in FIG. 3, this one direction of no rotation for each gear 21 is clockwise, all the gears 21 being permitted to rotate counterclockwise as viewed in the figure by their respective pawls 23.

A cogwheel 30 having a toothed outer perimeter 31 is dimensioned for meshing the outer toothed perimeter 31 with gears 21. A polygonal throughbore 32 is provided in cogwheel 30 for engagement of a nut or bolt head to be manipulated. In addition, the slot 33 extends between outer perimeter 31 and throughbore 32 for permitting access therethrough of a threaded shaft. This is best illustrated by further reference to FIG. 4 which illustrates a second cogwheel 30 having a substantially identical toothed outer perimeter, but a central polygonal throughbore 32 of smaller dimension for engaging a bolt or nut 35 of smaller dimension. Generally, a number of these cogwheels with different size polygonal throughbores will be provided to match or mate nuts and bolt heads of many different sizes.

Figure 4:
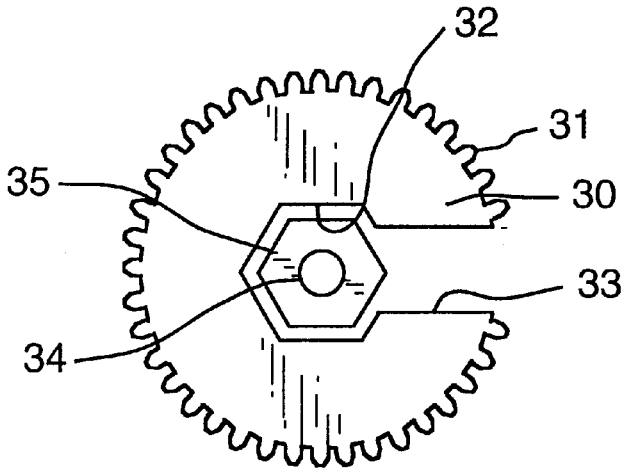
FIG. 4 is a view in side elevation of an alternative cogwheel which may be used in the wrench shown in FIGS. 1 through 3 for engaging a nut or bolt head of a smaller size.

As can be best seen in FIG. 4, the slot 33 of the cogwheel permits the central threaded shaft 34 on which nut 35 is received to have access through slot 33 so that the polygonal throughbore 32 may sequentially have access to the exterior surfaces of nut 35 for manipulation.

As can be seen from the drawings, a nut or bolt head such as nut 35 will be rotated in the clockwise direction as the handle 16 of the wrench is ratcheted back and forth. To turn the nut 35 in the opposite or counterclockwise direction, the wrench is removed and turned over 180° and then re-engaged with nut 35.

I claim:

1. An open-end hand held ratchet wrench comprising:

a rigid semi-circular jaw cradle defining an interior semi-circular channel which is substantially U-shaped in cross section and oriented so that an open side of said channel faces an axis of said cradle whereby said channel has two spaced apart open ends;

an elongated handle having one end secured to said cradle and extending radially outward therefrom on a side opposite from said channel;

at least two radial recesses arranged in spaced relationship in a bottom portion of said cradle channel and facing said axis;

a gear mounted in each recess for rotation on a gear axis which is parallel to said cradle axis with a portion of each gear protruding into said channel;

at least one ratchet pawl mounted in said cradle and positioned to prevent rotation of at least one of said gears in one direction; and a cogwheel having a toothed outer perimeter dimensioned for meshing with said gears and a polygonal throughbore and a slot extending between said outer perimeter and said throughbore, said cogwheel dimensioned to be freely slidable into said open ends of said channel for meshing said toothed outer perimeter with said gears.

2. The open-end handheld ratchet wrench of claim 1 including a ratchet pawl mounted in said cradle and respectively positioned to prevent rotation of all of said gears in said one direction.

3. The open-end hand held ratchet wrench of claim 1 including four of said radial recesses arranged in spaced relationship in the bottom portion of said cradle channel with one of said gears respectively mounted in each recess.

4. The open-end hand held ratchet wrench of claim 1 including at least two of said cogwheels, said cogwheels having substantially identical outer diameters, said polygonal throughbores of said cogwheels being of different sizes.

* * * * *